US007903998B2

(12) United States Patent
Matsumoto et al.

(10) Patent No.: US 7,903,998 B2
(45) Date of Patent: Mar. 8, 2011

(54) IMAGE FORMING APPARATUS

(75) Inventors: Mitsuyo Matsumoto, Ibaraki (JP); Chiyoshi Nozaki, Otsu (JP); Takuya Kadota, Kobe (JP); Katsunori Kurose, Takarazuka (JP); Tsuyoshi Nozaki, Ikeda (JP); Atsushi Yamamoto, Kawanishi (JP); Yoshimichi Ishikawa, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 423 days.

(21) Appl. No.: 12/046,866

(22) Filed: Mar. 12, 2008

(65) Prior Publication Data

US 2008/0232857 A1 Sep. 25, 2008

(30) Foreign Application Priority Data

Mar. 19, 2007 (JP) ..... 2007-071497

(51) Int. Cl.
*G03G 21/00* (2006.01)
*G03G 15/10* (2006.01)
*G03G 15/095* (2006.01)
*G03G 9/00* (2006.01)

(52) U.S. Cl. ..... 399/129; 399/249; 399/264; 430/110

(58) Field of Classification Search ..... 399/99, 399/129, 149, 150, 174, 245; 430/110.4
See application file for complete search history.

(56) References Cited

U.S. PATENT DOCUMENTS 5,940,661 A * 8/1999 Yagi et al. ..... 399/174
7,684,732 B2 * 3/2010 Fujita et al. ..... 399/129
7,725,054 B2 * 5/2010 Fujita et al. ..... 399/128
2006/0204882 A1 9/2006 Nozaki et al.
2006/0210902 A1 9/2006 Nakamura et al.
2006/0275686 A1 12/2006 Kadota et al.
2007/0026335 A1 2/2007 Yamamoto et al.
2007/0059625 A1 3/2007 Yamamoto et al.
2007/0166635 A1 7/2007 Yamamoto et al.
2007/0190442 A1 8/2007 Nakamura et al.
2007/0207399 A1 9/2007 Kadota et al.
2007/0212630 A1 * 9/2007 Yasunaga et al. ..... 430/108.7
2007/0217842 A1 9/2007 Kato et al.
2007/0218384 A1 9/2007 Matsumoto et al.
2007/0218388 A1 9/2007 Kurose et al.
2007/0218393 A1 9/2007 Nozaki et al.
2007/0238042 A1 10/2007 Yasunaga et al.
2007/0280735 A1 * 12/2007 Nagatomo et al. ..... 399/175
(Continued)

FOREIGN PATENT DOCUMENTS

JP 8-137368 5/1996
JP 11-184216 7/1999

*Primary Examiner* — David M Gray
*Assistant Examiner* — Francis Gray
(74) *Attorney, Agent, or Firm* — Oblon, Spivak, McClelland, Maier & Neustadt, L.L.P.

(57) ABSTRACT

An image forming apparatus having at least a latent electrostatic image bearing member, and a recharging unit configured to recharge a residual toner remaining on the latent electrostatic image bearing member, wherein after transfer, the residual toner is passed through the recharging unit and is then recovered in a developing device; a charging component of the recharging unit that comes into contact with the latent electrostatic image bearing member is a polymer sheet having a surface roughness (Ra) of 0.12 μm to 0.51 μm; the toner contains at least a pigment, a binder resin, and a releasing agent, and contains inorganic fine particles as an external additive, and the amount of the inorganic fine particles and the amount of the releasing agent satisfy three specific Expressions.

10 Claims, 2 Drawing Sheets

U.S. PATENT DOCUMENTS

2008/0063957 A1 3/2008 Murakami et al.
2008/0069617 A1 3/2008 Matsumoto et al.
2008/0070148 A1* 3/2008 Awamura et al. ..... 430/111.4
2008/0081273 A1 4/2008 Marakami et al.
2008/0131797 A1* 6/2008 Ishikawa et al. ..... 430/48
2008/0176159 A1* 7/2008 Matsumoto et al. ..... 430/109.4
2008/0232857 A1* 9/2008 Matsumoto et al. ..... 399/252

* cited by examiner

IMAGE FORMING APPARATUS

BACKGROUND OF THE INVENTION

1. Field of the Invention

The present invention relates to an electrophotographic image forming apparatus, image forming method, and process cartridge. Further, the present invention relates to an image forming apparatus and image forming method that make use of an electrostatic charge developing toner composition used in copiers, printers, and so forth employing electrophotographic technology, and more particularly relates to an image forming apparatus, image forming method, and process cartridge with which toner remaining on a latent electrostatic image bearing member is recovered and reused rather than being discarded, and furthermore the fouling of the charging member of the latent electrostatic image bearing member is prevented, the recovery of this remaining toner in the developing step is facilitated, and excellent image stability is obtained.

The present invention is applied to electronic paper coloring particles (the toner of the present invention can be applied without modification).

2. Description of the Related Art

A method in which a cleaning member is used to recover waste toner in a holding container has been employed in the past as a way to recover remaining toner on a latent electrostatic image bearing member after transfer. With contact cleaning, which is a typical cleaning method, an elastic body is brought into contact with the latent electrostatic image bearing member, and the waste toner is recovered in a container. These methods in which a cleaning member is used to recover remaining toner on a latent electrostatic image bearing member after transfer do not meet the environmental requirements in this field because they generate waste toner, nor do they meet the need for smaller devices that take up less space because enough space has to be left for the holding container.

One technique for dealing with this environmental problem is a cleaner-less image forming method. This is an image forming method in which image recording is performed without using a device for removing toner remaining after transfer. Using this cleaner-less image forming method makes it possible to eliminate the cleaning device, and also allows the toner remaining on the latent electrostatic image bearing member to be used again to form images, which makes this an extremely useful technique in that it provides an image forming apparatus with a smaller environmental footprint.

Also, because these cleaner-less image forming methods do not involve the use of a holding container, they allow the device to be more compact. That is, it is possible to satisfy the need for a smaller device, which is one of the things desired of electrophotographic printers and copiers. Therefore, a cleaner-less image forming method is an extremely effective technique that is more environmentally friendly and helps reduce the size of an image forming apparatus.

These cleaner-less image forming methods are known, for example, from Japanese Patent Application Laid-Open (JP-A) Nos. 11-184216 and 08-137368. In JP-A Nos. 11-184216 and 08-137368, there is no control of the adhesive components of the sheet, which is a recharging member, and toner, so adhesion to the sheet cannot be prevented, and it is difficult to completely prevent the occurrence of adhering matter.

BRIEF SUMMARY OF THE INVENTION

The present invention was conceived in light of the current state of prior art as discussed above, and it is an object thereof to provide an image forming apparatus that makes use of an electrostatic charge developing toner composition used in copiers, printers, and so forth employing electrophotographic technology, with which toner remaining on a latent electrostatic image bearing member is recovered and reused rather than being discarded, and furthermore the fouling of the charging member of the latent electrostatic image bearing member is prevented, the recovery of this remaining toner in the developing step is facilitated, and superior image stability is obtained, and to provide a toner, a toner container, and a process cartridge used for this purpose The stated object can be achieved by the following aspects of the present invention.

(1) An image forming apparatus having at least latent electrostatic image bearing member, and a recharging unit configured to recharge a residual toner remaining on the latent electrostatic image bearing member, wherein after transfer, the residual toner is passed through the recharging unit and is then recovered in a developing device; a charging component of the recharging unit that comes into contact with the latent electrostatic image bearing member is a polymer sheet having a surface roughness (Ra) of from 0.12 μm to 0.51 μm; the toner contains at least a pigment, a binder resin, and a releasing agent, and contains inorganic fine particles as an external additive, and the amount of the inorganic fine particles and the amount of the releasing agent satisfy the following Expressions 1, 2, and 3:

$$[A\times(100-B)]\times X<530 \quad \text{Expression 1}$$

$$[A\times(100-B)]>60 \quad \text{Expression 2}$$

$$X>2.5 \quad \text{Expression 3}$$

where A is the externally added inorganic fine particle content (wt % with respect to toner), B is the adhesive strength of the inorganic fine particles (%), and X is the amount of the releasing agent (wt % with respect to toner).

(2) The image forming apparatus according to the item (1), wherein toner particles of the toner have a volume average particle size of 4 microns or more and less than 8 microns, and the content of micropowder toner of 3 μm or smaller is 30 percent by number or less.

(3) The image forming apparatus according to any one of the items (1) and (2), wherein the adhesive force between toner particles is from 20 g to 50 g.

(4) The image forming apparatus according to any one of the items (1) to (3), wherein the circularity (S1) of the toner particles (=(the circumferential length of a perfect circle having the same projected area as a particle image)÷(the circumferential length of particle projection)) is 0.95 or more and less than 0.99.

(5) The image forming apparatus according to any one of the items (1) to (4) wherein the toner is obtained by removing an organic solvent after particles have been formed in an aqueous medium.

(6) The image forming apparatus according to any one of the items (1) to (5), wherein the toner is obtained by being washed with an aqueous washing medium after particles have been formed in an aqueous medium, and then being dried.

(7) The image forming apparatus according to any one of the items (1) to (6), wherein the releasing agent contains one or more selected from paraffins, synthetic esters, polyolefins, carnauba waxes, and rice waxes.

(8) The image forming apparatus according to any one of the items (1) to (7), wherein the toner is a non-magnetic single-component developing toner.

(9) The image forming apparatus according to any one of the items (1) to (8), wherein the polymer sheet has a conductive sheet portion selected from the group consisting of nylon, PTFE, PVDF, and urethane.

(10) The image forming apparatus according to any one of the items (1) to (9), being an image forming apparatus used to form a multicolor image.

(11) The image forming apparatus according to any one of the items (1) to (10), further having an endless intermediate transfer unit.

(12) The image forming apparatus according to any one of the items (1) to (11), further comprising a fixing unit being a roller equipped with a heating device.

(13) The image forming apparatus according to any one of the items (1) to (12), further having a fixing unit being a belt equipped with a heating device.

(14) A toner container, filled with a non-magnetic single-component developing toner, wherein the non-magnetic single-component developing toner contains at least a pigment, a binder resin, and a releasing agent, and contains inorganic fine particles as an external additive, and the amount of the inorganic fine particles and the amount of the releasing agent satisfy the following Expressions 1, 2, and 3:

$$[A\times(100-B)]\times X<530 \quad \text{Expression 1}$$

$$[A\times(100-B)]>60 \quad \text{Expression 2}$$

$$X>2.5 \quad \text{Expression 3}$$

(where A is the externally added inorganic fine particle content (wt % with respect to toner), B is the adhesive strength of the inorganic fine particles (%), and X is the amount of the releasing agent (wt % with respect to toner).

As will be understood from the following detailed and specific description, the present invention provides a novel and superior image forming apparatus that makes use of an electrostatic charge developing toner composition used in copiers, printers, and so forth employing electrophotographic technology, and with which toner remaining on a latent electrostatic image bearing member after electrostatic developing and transfer is recovered and reused rather than being discarded, and furthermore the fouling of the charging member of the latent electrostatic image bearing member is prevented, the recovery of this remaining toner in the developing step is facilitated, and superior image stability is obtained, and also provides a toner, a toner container, and a process cartridge used for this purpose.

DETAILED DESCRIPTION OF THE INVENTION

Figure 1:
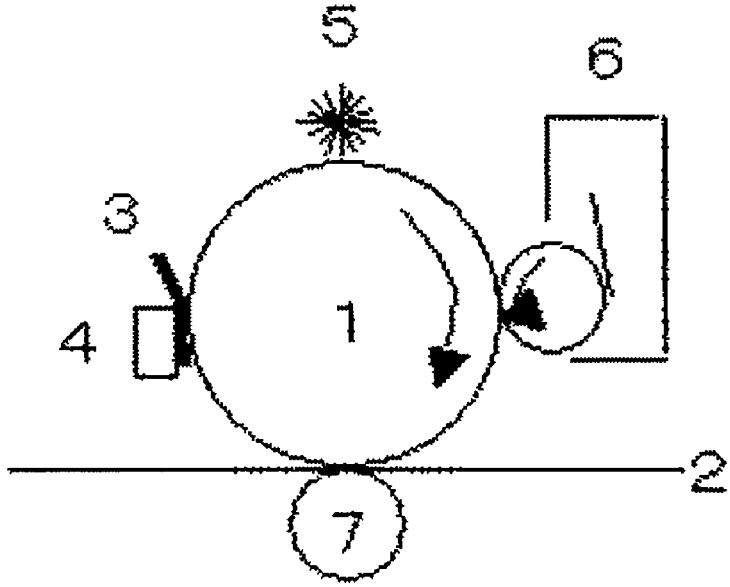
FIG. 1 is a concept diagram of a latent electrostatic image bearing member cleaner-less system.

As already discussed above, the present invention relates to an image forming method that makes use of an electrostatic charge developing toner composition used in copiers, printers, and so forth employing electrophotographic technology, and more particularly relates to an electrostatic charge developing toner composition and an image forming method with which toner remaining on a latent electrostatic image bearing member is recovered and reused rather than being discarded, and furthermore the fouling of the charging member of the latent electrostatic image bearing member is prevented, fouling by toner component of a sheet that recharges transferred toner and is provided to prevent fouling of the charging member of the latent electrostatic image bearing member is suppressed, the recovery of this remaining toner in the developing step is facilitated, and superior image stability is obtained. This invention will now be described in detail.

After a developed toner image has been transferred from a latent electrostatic image bearing member, any toner that remains on the latent electrostatic image bearing member surface either has markedly decreased charging, is uncharged, or is reverse-charged.

With an image forming apparatus/process cartridge not equipped with a cleaning component, this toner is conveyed to the charging member of the latent electrostatic image bearing member in the next step, and adheres to the contact-type latent electrostatic image bearing member charging member. The adhering toner can cause uneven charging when electrostatic images are being charged.

The adhering toner must be removed, and one possible way to accomplish this is to create a difference in the potentials of the latent electrostatic image bearing member and the latent electrostatic image bearing member charging member, so that the toner adheres to the latent electrostatic image bearing member and is recovered in the developing step.

With this method, the toner must be charged uniformly, with the same polarity, and there must be very little toner with reverse polarity, for the toner to be moved by the potential difference.

Also, in the recovery in the developing step, the toner must have as much or more charge as the toner prior to transfer, and there must be very little toner with reverse polarity.

One possible way to recover toner in the developing step is to create a difference in the potentials of the developing roller and the latent electrostatic image bearing member, so that the toner adheres to the roller and is recovered. If there is much toner of reverse polarity, not all the toner can be recovered by potential difference, and some will remain on the latent electrostatic image bearing member.

Any remaining toner fouls the background or the members, and long-lasting image stability will not be obtained.

Therefore, a charging member for recharging the toner remaining on the latent electrostatic image bearing member may be provided, and this prevents the fouling of the latent electrostatic image bearing member charging member, but there is the risk that the charging member for recharging the toner remaining on the latent electrostatic image bearing member will be fouled by toner component produced by rubbing.

The present invention can solve this problem, and with the toner of the present invention, the surface state of the charging member is optimized, hardness is optimized, the external addition state of the toner is optimized, and the releasing agent component present on the surface is optimized, which allows the above-mentioned problems to be avoided when toner remains on the latent electrostatic image bearing member, and provides an image forming method and process cartridge with little deterioration in durability.

If $[A\times(100-B)]\times X\geqq 530$, there is poor balance between the amount of free inorganic fine particles and the amount of releasing agent, so the releasing agent of the remaining toner becomes a starting point for the accumulation of inorganic fine particles, and micropowder toner and the like that builds up adheres to the recharging unit.

Also, if $A\times(100-B)\leqq 60$, the amount of inorganic fine particles will be so small that the resulting toner will not have adequate fluidity or chargeability.

Also, if the amount of releasing agent is less than 2.5%, the releasing agent will ooze onto the surface of the fixing member during fixing, so that there will be no sticking to the fixing member, but the small amount of releasing agent will mean that there will not be insufficient releasing effect to handle hot offset.

The toner of the present invention will now be described by giving specific examples.

The toner is manufactured by the dissolution and suspension method discussed in Journal of the Imaging Society of Japan [*Nihon Gazo Gakkai-shi*], Vol. 43, No. 1 (2004), or by a novel polymerization method in which a material containing at least a prepolymer composed of a modified polyester resin, and other toner composition components is dissolved or dispersed in an organic solvent, this solution or dispersion is dispersed in the form of droplets in an aqueous medium, and in this dispersion the prepolymer and other resin components are subjected to a crosslinking reaction and/or elongation reaction, and the solvent is removed from the resulting dispersion to obtain a toner. Preferably, a material containing at least a polyester resin (as a binder resin; may include a prepolymer composed of a modified polyester resin) and toner composition components, and/or a radical generator is dissolved or dispersed in an organic solvent, this solution or dispersion (called the oil phase) is emulsified or dispersed in an aqueous medium in the presence of a radical generator, and the solvent is removed to obtain a toner. This manufacturing method will be described below.

I. Oil Phase Material (I-1 Polyester Resin)

A polyester resin that does not contain any vinyl polymerizable groups is used for the binder resin of the present invention. This polyester can be an unmodified polyester obtained from a polycarboxylic acid and a polyol, a so-called modified polyester obtained from a polyester prepolymer having isocyanate groups, or another such known polyester resin. These polyester resins may be used singly or in combination of two or more.

(I-2 Modified Polyester Resin)

A polyester prepolymer having isocyanate groups can be used as a modified polyester resin in the present invention. An example of a polyester prepolymer having isocyanate groups (A) is one obtained by subjecting (1) a polyol and (2) a polycarboxylic acid to polycondensation to obtain a polyester having active hydrogen groups, and then reacting this with (3) a polyisocyanate. Examples of the above-mentioned active hydrogen groups had by the polyester include hydroxyl groups (alcoholic hydroxyl groups and phenolic hydroxyl groups), amino groups, carboxyl groups, and mercapto groups. Of these, alcoholic hydroxyl groups are preferred.

(I-2-1 Polyol)

Examples of the polyol (1) include alkylene glycols (such as ethylene glycol, 1,2-propylene glycol, 1,3-propylene glycol, 1,4-butanediol, and 1,6-hexanediol); alkylene ether glycols (such as diethylene glycol, triethylene glycol, dipropylene glycol, polyethylene glycol, polypropylene glycol, and polytetramethylene ether glycol); alicyclic diols (such as 1,4-cyclohexane dimethanol and hydrogenated bisphenol A); bisphenols (such as bisphenol A, bisphenol F, bisphenol S, 3,3'-difluoro-4,4'-dihydroxybiphenyl, and other such 4,4'-dihydroxyphenyls); bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A), 2,2-bis(3-hydroxyphenyl)-1,1,1,3,3,3-hexafluoropropane), and other such bis(hydroxyphenyl)alkanes; bis(3-fluoro-4-hydroxyphenyl)ether and other such bis(4-hydroxyphenyl)ethers; adducts of the above-mentioned alicyclic diols with an alkylene oxide (such as ethylene oxide, propylene oxide, or butylene oxide); and adducts of the above-mentioned bisphenols with an alkylene oxide (such as ethylene oxide, propylene oxide, or butylene oxide).

Of these, alkylene glycols having from 2 to 12 carbon atoms and adducts of a bisphenol with an alkylene oxide are preferable. Adducts of a bisphenol with an alkylene oxide, or a mixture of such an adduct and an alkylene glycol having from 2 to 12 carbon atoms is particularly favorable.

Other examples include trihydric to octahydric or higher polyhydric aliphatic alcohols (such as glycerol, trimethylolethane, trimethylolpropane, pentaerythritol, and sorbitol); trihydric and higher phenols (such as trisphenol PA, phenol novolac, and cresol novolac); and adducts of the above-mentioned trihydric or higher polyphenols mentioned with an alkylene oxide.

These polyols can be used singly or in combination of two or more, and are not limited to what is listed above.

(I-2-2 Polycarboxylic Acid)

Examples of the polycarboxylic acid (2) include alkylene dicarboxylic acids (such as succinic acid, adipic acid, and sebacic acid), alkenylene dicarboxylic acids (such as maleic acid and fumaric acid), and aromatic dicarboxylic acids (such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic anhydride). Of these, an alkenylene dicarboxylic acid having 4 to 20 carbon atoms, and an aromatic dicarboxylic acid having 8 to 20 carbon atoms are preferred. An aromatic polycarboxylic acid having 9 to 20 carbon atoms (such as trimellitic acid or pyromellitic acid), or an acid anhydride or a lower alkyl ester (such as a methyl ester, ethyl ester, or isopropyl ester) of the above, can be used as a trivalent or higher polycarboxylic acid to react with the polyol (1).

The above polycarboxylic acids can be used singly or in combination of two or more, and are not limited to what is listed above (I-2-3 Ratio of Polyol and Polycarboxylic Acid)

The ratio of the polyol (1) to the polycarboxylic acid (2), as the equivalence ratio OH/COOH of hydroxyl groups (OH) to carboxyl groups (COOH), is usually from 2/1 to 1/1, preferably from 1.5/1 to 1/1, and more preferably from 1.3/1 to 1.02/1.

(I-2-4 Polyisocyanate)

Examples of the polyisocyanate (3) include aliphatic polyisocyanates (such as tetramethylene diisocyanate, hexamethylene diisocyanate and 2,6-diisocyanate methylcaproate); alicyclic polyisocyanates (such as isophorone diisocyanate and cyclohexylmethane diisocyanate); aromatic diisocyanates (such as tolylene diisocyanate and diphenylmethane diisocyanate); aromatic aliphatic diisocyanates (such as $\alpha,\alpha,\alpha',\alpha'$-tetramethyl xylylene diisocyanate); isocyanurates; and blocked polyisocyanates in which the above polyisocyanates are blocked with a phenol derivative, an oxime, or a caprolactam. These can be used singly or in combination of two or more.

(I-2-5 Ratio of Isocyanate Groups to Hydroxyl Groups)

The ratio of the polyisocyanate (3), as isocyanate groups (NCO) to hydroxyl groups (OH) of the polyester having hydroxyl groups, is usually from 5/1 to 1/1, preferably from 4/1 to 1.2/1, and more preferably from 2.5/1 to 1.5/1. If NCO/OH is more than 5, the low temperature fixability of the toner degrades, but if the molar ratio of NCO is less than 1, the urea content in the modified polyester is so low that hot offset resistance is poor. The amount in which the constituent components of the polyisocyanate (3) are contained in the prepolymer (A) having an isocyanate group at its terminal is usually from 0.5 wt % to 40 wt %, preferably from 1 wt % to 30 wt %, and more preferably from 2 wt % to 20 wt %. If the amount is less than 0.5 wt %, hot offset resistance will degrade, and this is also disadvantageous in terms of the heat resistance and low temperature fixability of the toner. If the amount is more than 40 wt %, low temperature fixability will degrade.

(I-2-6 Number of Isocyanate Groups in Prepolymer)

The number of isocyanate groups included per molecule of the prepolymer (A) having isocyanate groups is usually 1 or more, preferably from 1.5 to 3 on average, and more preferably from 1.8 to 2.5 on average. If the number is less than 1 per molecule, the molecular weight of the modified polyester will be lower after crosslinking and/or elongation, and hot offset resistance will degrade.

(I-2-7 Crosslinking Agent and Elongation Agent)

An amine can be used as a crosslinking agent or elongation agent. Examples of the amine (B) include diamines (B1), trivalent or higher polyamines (B2), amino alcohols (B3), amino mercaptans (B4), amino acids (B5), and blocked amines (B6) in which the amines B1 to B5 are blocked.

Examples of the diamines B1 include aromatic diamines (such as phenylenediamine, diethyltoluenediamine, 4,4'-diaminodiphenylmethane, tetrafluoro-p-xylylenediamine, and tetrafluoro-p-phenylenediamine), alicyclic diamines (such as 4,4'-diamino-3,3'-dimethyldicyclohexylmethane, diaminocyclohexane, and isophoronediamine), and aliphatic diamines (such as ethylenediamine, tetramethylenediamine, hexamethylenediamine, dodecafluorohexylenediamine and tetracosafluorododecylene diamine).

Examples of the trivalent or higher polyamines B2 include diethylenetriamine and triethylenetetramine.

Examples of the amino alcohols B3 include ethanolamine, diethanolamine, and hydroxyethyl aniline.

Examples of the amino mercaptans B4 include aminoethyl mercaptan and aminopropyl mercaptan.

Examples of the amino acids B5 include aminopropionic acid and aminocaproic acid.

Examples of the blocked amines B6 in which the amines B1 to B5 are blocked include oxazoline compounds and ketimine compounds obtained from one of the above amines B1 to B5 and a ketone (such as acetone, methyl ethyl ketone, or methyl isobutyl ketone).

Of these amines B, either B1 alone or a mixture of B1 and a small amount of B2 is preferable.

(I-2-8 Stopping Agent)

The molecular weight of the modified polyester resin upon completion of the reaction can be adjusted as necessary using a reaction stopping agent for crosslinking and/or elongation. Examples of the stopping agent include monoamines (such as diethylamine, dibutylamine, butylamine, and laurylamine) and blocked amines (ketimine compounds) obtained by blocking the above monoamines.

(I-2-9 Ratio of Amino Groups to Isocyanate Groups)

The ratio of the amine B, as the equivalence ratio NCO/NHx of isocyanate groups (NCO) in the prepolymer A having isocyanate groups to amino groups (NHx) in the amine B, is usually from 1/2 to 2/1, preferably from 1.5/1 to 1/1.5, and more preferably from 1.2/1 to 1/1.2. If NCO/NHx is greater than 2 or less than ½, the molecular weight of the urea-modified polyester (i) will be low, and hot offset resistance will degrade.

(I-3 Unmodified Polyester)

It is important in the present invention that the toner binder contain not only the above-mentioned modified polyester A, but, along with A, an unmodified polyester C that serves as a toner binder component. Using component C improves low temperature fixability, and also improves gloss when the toner is used in a full-color device. Examples of component C include polycondensates of a polyol (1) (the same as the polyester component of A above) with a polycarboxylic acid (2), and preferred examples are also the polycondensates of a polyol (1) (the same as the polyester component of A above) with a polycarboxylic acid (2). Also, component C need not be just an unmodified polyester, and may be modified with chemical bonds other than urea bonds. For instance, it may be modified with urethane bonds.

It is preferable in terms of low temperature fixability and hot offset resistance for at least part of components A and C to be miscible. Therefore, component C preferably has a composition similar to that of the polyester component A. The weight ratio of A to C when A is contained is usually from 5/95 to 75/25, preferably from 10/90 to 25/75, more preferably from 12/88 to 25/75, and particularly preferably 12/88 to 22/78. If the weight ratio of component A is less than 5%, hot offset resistance will degrade, and this will also be disadvantageous in terms of the heat resistance and low temperature fixability.

(I-3-1 Molecular Weight of Unmodified Polyester)

The peak molecular weight of component C is usually from 1,000 to 30,000, preferably from 1,500 to 10,000, and more preferably from 2,000 to 8,000. If it is less than 1,000, heat resistance will degrade, but if it is more than 10,000, low temperature fixability will degrade. It is preferable for component C to have a hydroxyl value of 5 or more, preferably from 10 to 120, and more preferably from 20 to 80. If the hydroxyl value is less than 5, this is disadvantageous in terms of heat resistance and low temperature fixability. Component C usually has an acid value of from 0.5 to 40, and preferably from 5 to 35. Imparting an acid value tends to results in negative charging. Also, a compound in which the acid value and hydroxyl value both exceed their range will be prone to being affected by the environment under high temperature and humidity and under low temperature and humidity, and this often leads to deterioration of the image.

(I-4 Colorant)

Any known dyes and pigments can be used as colorants in the present invention. Examples include carbon black, Nigrosine dyes, black iron oxide, Naphthol Yellow S, Hansa Yellow (10G, 5G, and G), Cadmium Yellow, yellow iron oxide, loess, chrome yellow, titanium yellow, polyazo yellow, Oil Yellow, Hansa Yellow (GR, A, RN, and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, Permanent Red (F2R, F4R, FRL, FRLL, and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, Perinone Orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures of these. The colorant content in the toner is usually from 1 wt % to 15 wt %, and preferably from 3 wt % to 10 wt %, with respect to the toner.

(I-4-1 Producing Colorant Master Batch)

The colorant used in the present invention can also be compounded with a resin and used as a master batch. Examples of the binder resin kneaded along with the master batch or used in the manufacture of the master batch include the modified and unmodified polyester resins listed above, as well as styrene polymers and substituted styrene polymers (such as polystyrenes, poly-p-chlorostyrenes, and polyvinyltoluenes), styrene copolymers (such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acid resins, rosins, modified rosins, terpene resins, aliphatic or alicyclic hydrocarbon resins, aromatic petroleum resins, chlorinated paraffins, and paraffin waxes. These resins can be used singly or in mixtures.

(I-4-2 Master Batch Production Method)

The master batch can be obtained by mixing the master batch resin and the colorant and kneading the mixture under a high shearing force. An organic solvent can be used to increase the interaction between the colorant and the resin. What is known as a flushing method, in which an aqueous paste including a colorant and water is mixed and kneaded with a resin and an organic solvent so that the colorant migrates to the resin side, and the organic solvent and water are removed, can be used favorably because the colorant wet cake can be used directly, without having to be dried first. When mixing and kneading the components, it is preferable to use a high-shear dispersing device such as a triple roll mill. The master batch can also be prepared as dispersion or solution (wet master) of the organic solvent used for the oil phase, in order to improve dispersion or dissolution into the solvent in the production of the oil phase.

(I-5 Waxes)

The toner pertaining to the present invention can also contain a wax in addition to the toner binder and colorant. This wax can be any of the known waxes discussed in Properties and Applications of Wax [*Kaitei, Wakkusu no Seishitsu to Oyo*], Revised Second Edition, by Kenzo Fusegawa (Saiwai Shobo), and elsewhere. Examples include polyethylene wax, polypropylene wax, and other polyolefin waxes; paraffin wax, Sasol wax, and other paraffins; trimethylolpropane tribehenate, pentaerythritol tetrabehenate, pentaerythritol diacetate dibehenate, glycerol tribehenate, 1,18-octadecanediol distearate, tristearyl trimellitate, distearyl maleate, octadecyl stearate, and other synthetic esters; carnauba wax, rice wax, candelilla wax, and other natural vegetable waxes; montan wax, ozokerite, ceresin, and other natural mineral waxes; and steric acid amide and other fatty acid amide-based synthetic waxes. Of these, polyolefins, paraffins, synthetic esters, carnauba wax, and rice wax are preferable. These can be used singly or in combination of two or more.

The endothermic peak of the wax during temperature elevation, measured by differential scanning calorimeter (DSC), can be from 60° C. to 115° C., but fluidity will degrade if the melting point is lower than 60° C., and fixability tends to degrade if the melting point is more than 115° C.

(I-6 Organic Solvent of Oil Phase)

The toner pertaining to the present invention can be obtained by dissolving or dispersing a toner composition composed of at least a colorant and a polyester (serving as a binder resin) in an organic solvent, emulsifying or dispersing the resulting solution or dispersion in an aqueous medium in which a radical generator is present, in the presence of an inorganic dispersing agent or resin fine particles, and then removing the solvent. The above-mentioned polyester serving as the binder resin does not contain any vinyl polymerizable groups.

The organic solvent in which the toner composition composed of a polyester resin and a colorant is dissolved or dispersed preferably has a Hansen solubility parameter as described, for example, in "Polymer Handbook," 4th Edition, Wiley-Interscience, Volume 2, Section VII, of 19.5 or less, and it is particularly favorable for the boiling point of this solvent to be lower than 150° C. so that the solvent can be easily removed later. Examples of this organic solvent include hexane, cyclohexane, toluene, xylene, benzene, carbon tetrachloride, 1,1-dichloroethane, 1,1,1-trichloroethane, trichloroethylene, chloroform, methyl acetate, ethyl acetate, butyl acetate, methyl ethyl ketone, and tetrahydrofuran. These can be used singly or in combination of two or more.

II. Aqueous Medium Material (II-1 Aqueous Medium)

Water alone can be used as the aqueous medium, but a solvent which can be mixed with water can also be used. Examples of such miscible solvents include alcohols (such as methanol, isopropanol and ethylene glycol), dimethylformamide, tetrahydrofuran, cellosolves (such as methyl cellosolve), and lower ketones (such as acetone and methyl ethyl ketone). Further, the above-mentioned organic solvents used for the oil phase and having a Hansen solubility parameter of 19.5 or less can also be added, and preferably the added amount is near the saturation amount in water, as this will improve the emulsification or dispersion stability of the oil phase. The amount in which the aqueous medium is used is usually from 50 parts by weight to 2,000 parts by weight, and preferably from 100 parts by weight to 1,000 parts by weight, per 100 parts by weight of toner composition. If the amount is less than 50 parts by weight, the toner composition will not be dispersed well, and toner particles of the specified size will not be obtained. If the amount is more than 2,000 parts by weight, it is not economical. There are no particular restrictions on the radical generator added to the aqueous phase as long as it can be dispersed or dissolved in water, and just one radical generator may be used, or two or more may be combined. Furthermore, an oxidant and a reductant may be combined to utilize a redox reaction. The added amount is adjusted with respect to the toner solids according to the granulation temperature or the type of radical generator, but is from 0.1 wt % to 20 wt %, and preferably from 0.5 wt % to 10%.

(II-2 Radical Generator)

The radical generator of the present invention can be any compound known as a so-called polymerization initiator, and can be, for example, the ones discussed in "Polymer Handbook," 4th Edition, Wiley-Interscience, Volume 1, Section II. The radical generator can be added to the oil phase and/or the aqueous phase. When added to the oil phase, an oil-soluble polymerization initiator is preferably used, and when added to the aqueous phase, a water-soluble polymerization initiator is preferably used.

Examples of oil-soluble polymerization initiators include 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and other azo and diazo polymerization initiators; benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, tris-(t-butylperoxy)triazine, and other peroxide polymerization initiators; and macromolecular initiators having a side-chain of peroxide.

Examples of water-soluble polymerization initiators include potassium persulfate, ammonium persulfate, and other persulfates; 2,2'-azobis(2-methylpropioneamidine dihydrochloride), 2,2'-azobis[N-(2-carboxyethyl)-2-methylpropioneamidine], 4,4-azobis-(4-cyanovaleric acid)azobisaminodipropane acetate, azobiscyanovaleric acid and salts thereof, and hydrogen peroxide.

(II-3 Inorganic Dispersing Agent)

A solution or dispersion of the toner composition is dispersed in the aqueous medium in the presence of an inorganic dispersing agent or resin fine particles.

Examples of inorganic dispersing agents include tricalcium phosphate, calcium carbonate, titanium oxide, colloidal silica, and hydroxyapatite. Using a dispersing agent is preferable because the resulting particles will have a sharp particle size distribution and good dispersion stability.

(II-4 Resin Fine Particles)

Resin fine particles are also preferably added to the toner pertaining to the present invention. The resin that forms these fine particles can be any resin with which an aqueous dispersion can be formed, and may be either a thermoplastic resin or a thermosetting resin. Examples include vinyl resin, polyurethane resin, epoxy resin, polyester resin, polyamide resin, polyimide resin, silicon resin, phenol resin, melamine resin, urea resin, aniline resin, ionomer resin, and polycarbonate resin. Two or more of these resins can also be used. Of these, it is preferable to use a vinyl resin, a polyurethane resin, a epoxy resin, a polyester resin, or a combination of these because these resins will readily form aqueous dispersions of fine, spherical resin particles.

(II-4-1 Description of Vinyl Resin)

A vinyl resin is a polymer obtained by the homopolymerization or copolymerization of a vinyl monomer. Examples of vinyl monomers include (1) to (10) below.

(1) Vinyl Hydrocarbons:

aliphatic vinyl hydrocarbons such as alkenes (such as ethylene, propylene, butene, isobutylene, pentene, heptene, diisobutylene, octene, dodecene, octadecene, and α-olefins other than those listed above) and alkadienes (such as butadiene, isoprene, 1,4-pentadiene, 1,6-hexadiene, and 1,7-octadiene);

alicyclic vinyl hydrocarbons such as mono- and dicycloalkenes and mono- and dicycloalkadienes (such as cyclohexene, (di)cyclopentadiene, vinylcyclohexene, and ethylidene bicycloheptene), and terpenes (such as pinene, limonene, and indene); and aromatic vinyl hydrocarbons such as styrene and hydrocarbyl (alkyl, cycloalkyl, aralkyl and/or alkenyl) substituted derivatives thereof (such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, and trivinylbenzene), and vinylnaphthalene.

(2) Vinyl monomers including a carboxyl group, and salts thereof:

unsaturated monocarboxylic or dicarboxylic acid having 3 to 30 carbon atoms, and anhydrides and monoalkyl (1 to 24 carbon atoms) esters thereof (such as (meth)acrylic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, and cinnamic acid); and salts thereof.

(3) Vinyl monomers including a sulfonic group, and vinyl monoesters of sulfuric acid, and salts thereof:

alkene sulfonic acids having 2 to 14 carbon atoms (such as vinyl sulfonic acid, (meth)allyl sulfonic acid, methyl vinyl sulfonic acid, and styrene sulfonic acid), and alkyl derivatives thereof having 2 to 24 carbon atoms (such as α-methylstyrene sulfonic acid); sulfo(hydroxy)alkyl-(meth)acrylates or (meth)acrylamides (such as sulfopropyl (meth)acrylate, 2-hydroxy-3-(meth)acryloxypropyl sulfonic acid, 2-(meth) acryloylamino-2,2-dimethylethane sulfonic acid, 2-(meth) acryloyloxyethane sulfonic acid, 3-(meth)acryloyloxy-2-hydroxypropane sulfonic acid, 2-(meth)acrylamide-2-methylpropane 20 sulfonic acid, 3-(meth)acrylamide-2-hydroxypropane sulfonic acid, alkyl (3 to 18 carbon atoms) allylsulfosuccinic acid, sulfuric acid ester of poly (n=2 to 30) oxyalkylene (ethylene, propylene, or butylene alone, or a random or block copolymer thereof) mono(meth)acrylate (such as sulfuric acid ester of poly (n=5 to 15) oxypropylene monomethacrylate), and sulfuric acid ester of polyoxyethylene polycyclic phenyl ether).

(4) Vinyl monomers including a phosphate group, and salts thereof:

(meth)acryloyloxyalkyl phosphoric acid monoesters (such as 2-hydroxyethyl (meth)acryloyl phosphate, phenyl-2-acryloyloxyethyl phosphate); (meth)acryloyloxyalkyl (1 to 24 carbon atoms) phosphonic acids (such as 2-acryloyloxyethyl phosphonic acid); and salts thereof.

Examples of salts of the above-mentioned monomers (2) to (4) include alkali metal salts (such as sodium salts and potassium salts), alkaline earth metal salts (such as calcium salts and magnesium salts), ammonium salts, amine salts, and quaternary ammonium salts.

(5) Vinyl monomers including a hydroxyl group:

hydroxystyrene, N-methylol (meth)acrylamide, hydroxyethyl (meth)acrylate, hydroxypropyl (meth)acrylate, polyethylene glycol mono(meth)acrylate, (meth)allyl alcohol, crotyl alcohol, isocrotyl alcohol, 1-buten-3-ol, 2-buten-1-ol, 2-butene-1,4-diol, propargyl alcohol, 2-hydroxyethyl propenyl ether, and sucrose allyl ether.

(6) Vinyl monomers containing nitrogen:

vinyl monomers including an amino group (such as aminoethyl (meth)acrylate, dimethylaminoethyl (meth)acrylate, diethylaminoethyl (meth)acrylate, t-butylaminoethyl (meth) acrylate, N-aminoethyl(meth)acrylamide, (meth)allylamine, morpholinoethyl (meth)acrylate, 4-vinylpyridine, 2-vinylpyridine, crotylamine, N,N-dimethylaminostyrene, methyl-α-acetaminoacrylate, vinylimidazole, N-vinylpyrrole, N-vinylthiopyrrolidone, N-arylphenylenediamine, aminocarbazole, aminothiazole, aminoindole, aminopyrrole, aminoimidazole, aminomercaptothiazole, and salts of these);

vinyl monomers including an amide group (such as (meth) acrylamide, N-methyl(meth)acrylamide, N-butylacrylamide, diacetoneacrylamide, N-methylol(meth)acrylamide, N,N-methylene-bis(meth) acrylamide, cinnamic acid amide, N,N-dimethylacrylamide, N,N-dibenzylacrylamide, methacrylformamide, N-methyl-N-vinylacetamide, and N-vinylpyrrolidone);

vinyl monomers including a nitrile group (such as (meth) acrylonitrile, cyanostyrene, and cyanoacrylate);

vinyl monomers including a quaternary ammonium cation group, such as quaternized vinyl monomers containing a tertiary amine group (such as dimethylaminoethyl (meth)acrylate, diethylaminoethyl (meth)acrylate, dimethylaminoethyl (meth)acrylamide, diethylaminoethyl(meth)acrylamide, and diallylamine) (quaternized using a quaternizing agent such as methyl chloride, dimethyl sulfuric acid, benzyl chloride, or dimethyl carbonate); and vinyl monomers including a nitro group (such as nitrostyrene).

(7) Vinyl monomers including an epoxy group:

such as glycidyl (meth)acrylate, tetrahydrofurfuryl (meth) acrylate, and p-vinylphenylphenyloxide.

(8) Vinyl esters, vinyl (thio)ethers, vinyl ketones, vinyl sulfones:

vinyl esters (such as vinyl acetate, vinyl butyrate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinyl methoxyacetate, vinyl benzoate, ethyl-α-ethoxyacrylate, alkyl (meth)acrylates with an alkyl group having 1 to 50 carbon atoms (such as methyl (meth)acrylate, ethyl (meth)acrylate, propyl (meth)acrylate, butyl (meth) acrylate, 2-ethylhexyl (meth)acrylate, dodecyl (meth)acrylate, hexadecyl (meth)acrylate, heptadecyl (meth)acrylate, and eicosyl (meth)acrylate), dialkyl fumarates (the two alkyl groups 1.5 have 2 to 8 carbon atoms and have a straight-chain, branched-chain, or alicyclic structure), dialkyl maleates (the two alkyl groups have 2 to 8 carbon atoms and have a straight-chain, branched-chain, or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers having a polyalkylene glycol chain (such as polyethylene glycol (molecular weight of 300) mono(meth)acrylate, polypropylene glycol (molecular weight of 500) monoacrylate, an adduct of methyl alcohol (meth)acrylate with 10 mol of ethylene oxide, and an adduct of lauryl alcohol (meth)acrylate with 30 mol of ethylene oxide), and poly(meth)acrylates (such as (meth) acrylates of polyhydric alcohols such as ethylene glycol di(meth)acrylate, propylene glycol di(meth)acrylate, neopentyl glycol di(meth)acrylate, trimethylolpropane tri(meth) acrylate, and polyethylene glycol di(meth)acrylate));

vinyl (thio)ethers (such as vinyl methyl ether, vinyl ethyl ether, vinyl propyl ether, vinyl butyl ether, vinyl-2-ethylhexyl ether, vinyl phenyl ether, vinyl-2-methoxyethyl ether, methoxybutadiene, vinyl-2-butoxyethyl ether, 3,4-dihydro-1,2-pyran, 2-butoxy-2'-vinyloxydiethyl ether, vinyl-2-ethylmercaptoethyl ether, acetoxystyrene, and phenoxystyrene);

vinyl ketones (such as vinyl methyl ketone, vinyl ethyl ketone, and vinyl phenyl ketone); and vinyl sulfones (such as divinyl sulfide, p-vinyl diphenyl sulfide, vinyl ethyl sulfide, vinyl ethyl sulfone, divinyl sulfone, and divinyl sulfoxide).

(9) Other vinyl monomers:

such as isocyanatoethyl (meth)acrylate and m-isopropenyl-α,α-dimethylbenzyl isocyanate.

(10) Vinyl monomers containing fluorine:

4-fluorostyrene, 2,3,5,6-tetrafluorostyrene, pentafluorophenyl (meth)acrylate, pentafluorobenzyl (meth)acrylate, perfluorocyclohexyl (meth)acrylate, perfluorocyclohexylmethyl (meth)acrylate, 2,2,2-trifluoroethyl (meth)acrylate, 2,2,3,3-tetrafluoropropyl (meth)acrylate, 1H,1H,4H-hexafluorobutyl (meth)acrylate, 1H,1H,5H-octafluoropentyl (meta) acrylate, 1H, 1H, 7H-dodecafluoroheptyl (meth)acrylate, perfluorooctyl (meth)acrylate, 2-perfluorooctylethyl (meth) acrylate, heptadecafluorodecyl (meth)acrylate, trihydroperfluoroundecyl (meth)acrylate, perfluoronorbornylmethyl (meth)acrylate, 1H-perfluoroisobornyl (meth)acrylate, 2-(N-butylperfluorooctanesulfoneamide)ethyl (meth)acrylate, 2-(N-ethylperfluorooctanesulfoneamide)ethyl (meth)acrylate;

derivatives of α-fluoroacrylic acid; and bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate, vinyl heptafluorobutyrate, vinyl perfluoroheptanoate, vinyl perfluorononanoate, and vinyl perfluorooctanoate.

(II-4-2 Vinyl Copolymer)

Examples of copolymers of a vinyl monomer include polymers obtained by copolymerizing two or more of any of the monomers listed under (1) to (10) above, in any ratio, such as styrene-(meth)acrylate copolymer, styrene-butadiene copolymer, (meth) acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer. When fluorine is introduced into the resin particles, one or more of the monomers listed under (10) above can be copolymerized in any ratio.

(II-4-3 Vinyl Resin Monomer Ratio)

The above-mentioned resin must not completely dissolve in water, at least under the conditions for forming the aqueous dispersion, so that resin fine particles can be formed in the aqueous dispersion. Accordingly, when the vinyl resin is a copolymer, it is generally preferable if the ratio of hydrophobic monomer to hydrophilic monomer constituting the vinyl resin, although it will depend on the types of monomers selected, is 10% or more hydrophobic monomer, and more preferably 30% or more. If the proportion of hydrophobic monomer is less than 10%, the vinyl resin will be water-soluble, and the particle size of the toner will lose its uniformity. The term "hydrophilic monomer" as used here means a monomer that will dissolve in any ratio in water, and "hydrophobic monomer" means a monomer to which this does not apply (a monomer that basically is immiscible with water).

(II-4-4 Method for Dispersing Resin Fine particles in Aqueous System)

There are no particular restrictions on the method for making the resin into an aqueous dispersion of resin fine particles, but the following (a) to (h) are examples.

(a) When the resin is a vinyl resin, an aqueous dispersion of resin fine particles is directly formed by polymerization reaction (such as suspension polymerization, emulsion polymerization, seed polymerization, or dispersion polymerization), using monomers as the starting raw material.

(b) When the resin is a polyaddition resin or a polycondensation resin such as a polyester resin, polyurethane resin, or epoxy resin, a precursor (such as a monomer or oligomer) or a solvent solution of the precursor is dispersed in an aqueous medium in the presence of a suitable dispersing agent, after which this product is heated or a curing agent is added to cure the material and manufacture an aqueous dispersion of resin fine particles.

(c) When the resin is a polyaddition resin or a polycondensation resin such as a polyester resin, polyurethane resin, or epoxy resin, a suitable emulsifying agent is dissolved in a precursor (such as a monomer or oligomer) or a solvent solution of the precursor (preferably in liquid form; may be liquefied by heating), after which water is added to phase-inversion emulsification is performed.

(d) A resin produced by a polymerization reaction (such as addition polymerization, ring cleavage polymerization, polyaddition, addition condensation, condensation polymerization, or any other such polymerization reaction format) is pulverized using a mechanical rotational type pulverizer or a jet type pulverizer, and then classified, to obtain resin fine particles, after which these are dispersed in water in the presence of a suitable dispersing agent.

(e) A resin formed by a polymerization reaction (such as addition polymerization, ring cleavage polymerization, polyaddition, addition condensation, condensation polymerization, or any other such polymerization reaction format) is dissolved in a solvent, and then the resin solution is sprayed as a mist to obtain resin fine particles, after which these are dispersed in water in the presence of a suitable dispersing agent.

(f) A resin formed by a polymerization reaction (such as addition polymerization, ring cleavage polymerization, polyaddition, addition condensation, condensation polymerization, or any other such polymerization reaction format) is dissolved in a solvent to prepare a resin solution, to which a solvent is added, or a resin solution that has been heated and dissolved in a solvent is cooled, thereby precipitating resin fine particles, and then the solvent is removed so that resin fine particles are obtained, after which these are dispersed in water in the presence of a suitable dispersing agent.

(g) A resin formed by a polymerization reaction (such as addition polymerization, ring cleavage polymerization, polyaddition, addition condensation, condensation polymerization, or any other such polymerization reaction format) is dissolved in a solvent, and then the resin solution is dispersed in an aqueous medium in the presence of a suitable dispersing agent, and this dispersion is heated, subjected to reduced pressure, etc., to remove the solvent.

(h) A resin formed by a polymerization reaction (such as addition polymerization, ring cleavage polymerization, polyaddition, addition condensation, condensation polymerization, or any other such polymerization reaction format) is dissolved in a solvent to prepare a resin solution, and then a suitable emulsifying agent is dissolved in the resin solution, after which water is added and phase-inversion emulsification is performed.

(II-4-5 Resin Fine Particle Size)

The resin fine particles are usually smaller in size than the toner particles, and from the standpoint of particle size uniformity, the value of the particle size ratio ((volume average particle size of resin fine particles)÷(volume average particle size of toner)) is preferably between 0.001 and 0.3. If this particle size ratio is greater than 0.3, the resin fine particles will not be efficiently adsorbed to the surface of the toner, so the toner thus obtained will tend to have a wider particle size distribution. Also, the volume average particle size of the resin fine particles can be suitably adjusted within the above-mentioned particle size ratio so as to achieve a particle size suited to obtaining a toner with the desired particle size. For instance, when a toner with a volume average particle size of 5 μm is to be obtained, the range is preferably 0.0025 μm to 1.5 μm, and more preferably 0.005 μm to 1.0 μm, and when a toner of 10 μm is to be obtained, the range is preferably 0.005 μm to 3.0 μm, and more preferably 0.05 μm to 2.0 μm. The volume average particle size can be measured with a laser-Doppler particle size distribution analyzer (UPA-150, manufactured by Nikkiso), a laser particle size distribution analyzer (LA-920 manufactured by Horiba), or a Multisizer II (manufactured by Coulter).

(II-5 Surfactant)

A surfactant or the like can be used as needed to emulsify or disperse the oil phase in which the toner composition is contained in an aqueous medium. Examples of surfactants include anionic surfactants such as alkylbenzenesulfonates, α-olefin sulfonates, and phosphoric acid esters; cationic surfactants such as amine salts (such as alkyl amine salts, aminoalcohol fatty acid derivatives, polyamine fatty acid derivatives, and imidazoline), and quaternary ammonium salts (such as alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amine derivatives and polyhydric alcohol derivatives; and amphoteric surfactants such as alanine, dodecyldi(aminoethyl)glycine, di(octylaminoethyl)glycine, and N-alkyl-N,N-dimethylammonium betaine. By using a surfactant having a fluoroalkyl group, the effect of the surfactant can be achieved by using on a small amount thereof. Examples of anionic surfactants having a fluoroalkyl group and that can be used favorably include fluoroalkyl carboxylic acids having from 2 to 10 carbon atoms and metal salts thereof, disodium perfluorooctanesulfonyl glutamate, sodium 3-[ω-fluoroalkanoyl ($C_6$-$C_{11}$)oxy]-1-alkyl($C_3$-$C_4$) sulfonate, sodium 3-[ω-fluoroalkanoyl($C_6$-$C_8$)-N-ethylamino]-1-propanesulfonate, fluoroalkyl($C_{11}$-$C_{20}$) carboxylic acid and metal salts thereof, perfluoroalkyl($C_7$-$C_{13}$) carboxylic acid and metal salts thereof, perfluoroalkyl($C_4$-$C_{12}$)sulfonic acid and metal salts thereof, perfluorooctanesulfonic acid diethanol amide, N-propyl-N-(2-hydroxyethyl)perfluorooctanesulfone amide, perfluoroalkyl($C_6$-$C_{10}$)sulfonamide propyl trimethyl ammonium salts, perfluoroalkyl($C_6$-$C_{10}$)-N-ethylsulfonylglycine salts, and monoperfluoroalkyl($C_6$-$C_{16}$)ethyl phosphates. Examples of cationic surfactants include primary, secondary and tertiary amines having a fluoroalkyl group, aliphatic quaternary ammonium salts such as perfluoroalkyl($C_6$-$C_{10}$)sulfonamide propyl trimethyl ammonium salts, benzalkonium salts, benzetonium chloride, pyridinium salts, and imidazolinium salts.

(II-6 Protective Colloid)

It is also possible to stabilize dispersion droplets with a polymeric protective colloid. Examples include homopolymers and copolymers of monomers such as acids (such as acrylic acid, methacrylic acid, α-cyanoacrylic acid, α-cyanomethacrylic acid, itaconic acid, crotonic acid, fumaric acid, maleic acid, and maleic anhydride), acrylic monomers having a hydroxyl group (such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerol monoacrylic acid esters, glycerol monomethacrylic acid esters, N-methylolacrylamide, and N-methylolmethacrylamide), vinyl alcohol and ethers of vinyl alcohol (such as vinyl methyl ether, vinyl ethyl ether, and vinyl propyl ether), esters of vinyl alcohol and a compound having a carboxyl group (such as vinyl acetate, vinyl propionate, and vinyl butyrate), acrylamide, methacrylamide, diacetoneacrylamide, and methylol compounds thereof, acid chlorides (such as acrylic acid chloride and methacrylic acid chloride), and monomers having a nitrogen atom or a hetero ring (such as vinyl pyridine, vinyl pyrrolidone, vinyl imidazole, and ethyleneimine); as well as compounds based on polyoxyethylene compounds (such as polyoxyethylene, polyoxypropylene, polyoxyethylene alkylamines, polyoxypropylene alkylamines, polyoxyethylene alkylamides, polyoxypropylene alkylamides, polyoxyethylene nonylphenyl ethers, polyoxyethylene lauryl phenyl ethers, polyoxyethylene stearyl phenyl esters, and polyoxyethylene nonylphenyl esters), and cellulose compounds (such as methyl cellulose, hydroxyethyl cellulose, and hydroxypropyl cellulose). When compounds such as calcium phosphate that are soluble in acids and alkalies are used as a dispersion stabilizer, the calcium phosphate is removed from the fine particles by a method such as dissolving the calcium phosphate with an acid such as hydrochloric acid and then washing with water. When a dispersing agent is used, the dispersing agent can be left on the toner particle surface, but it is preferably washed away after the elongation and/or crosslinking reaction, as this will improve the charging of the toner.

(III Dispersion and Emulsification Method)

There are no particular restrictions on the dispersion and emulsification method, and any known equipment can be used, such as low-shear equipment, high-shear equipment, friction equipment, high-pressure jet equipment, and ultrasonic equipment. To adjust the particle size of the dispersion to between 2 μm and 20 μm, high-shear equipment is preferable. When high-shear equipment is used, there are no particular restrictions on the rotational speed, but it is usually from 1,000 rpm to 30,000 rpm, and preferably from 5,000 rpm to 20,000 rpm. Although there are no particular restrictions on the dispersion time, it is normally 0.1 minutes to 5 minutes in the case of a batch method. The temperature during dispersion is usually from 0° C. to 150° C. (under pressure), and preferably from 20° C. to 90° C. A higher temperature is preferable because the toner composition containing a polyester resin will have a low viscosity and be easier to disperse.

To promote radical generation from the above-mentioned radical generator, it is preferable to heat as appropriate, taking into account the pyrolysis half-life temperature thereof, for example, and the temperature can be selected from a range of 20° C. to 90° C. A suitable heat treatment can also be performed at some point in the process between dispersal and solvent removal (discussed below).

(IV Elongation Reaction)

With the present invention, when a urea-modified polyester is obtained from a polyester prepolymer, an amine and a sulfonation agent may be mixed in the oil phase and then reacted with the prepolymer, before the toner composition is dispersed in the aqueous medium, or the toner composition may be dispersed in the aqueous medium, and then an amine added and a reaction brought about from the particle interface. In the latter case, a urea-modified polyester is generated preferentially at the surface of the produced toner particles, and a concentration gradient can also be provided within the particles. How long the above-mentioned addition reaction takes is selected according to the reactivity between the isocyanate group structure of the polyester prepolymer and the added amine, but is usually from 1 minute to 40 hours, and preferably from 1 to 24 hours. The reaction temperature is usually from 0° C. to 150° C. and preferably from 20° C. to 98° C. A known catalyst can also be used as needed, specific examples of which include dibutyltin laurate and dioctyltin laurate.

(V Solvent Removal)

In order to remove the organic solvent from the emulsion thus obtained, a method can be employed in which the temperature of the entire system is gradually raised to completely evaporate off the organic solvent from the droplets. Alternatively, it is also possible to employ a method in which the emulsion is sprayed in a dry atmosphere to completely remove the water-insoluble organic solvent in the droplets and form toner fine particles, and also to evaporate off the aqueous component. The dry atmosphere into which the emulsion is sprayed is generally a heated gas such as air, nitrogen, carbon dioxide, or a combustion gas, and in particular, can be any of various gas flows heated to a temperature higher than the boiling point of the solvent with the highest boiling point used. The required quality can be attained by treatment for just a short time, using a spray dryer, belt dryer, rotary kiln, or the like.

(VI Wet Classification)

The toner has a wide particle size distribution during emulsion, and when this particle size distribution is maintained after the toner has been washed and dried, the toner particles can be classified and adjust to the desired particle size distribution. The classification operation can be performed in a liquid, using a cyclone, a decanter, a centrifuge, or the like to remove the microparticle portion. Of course, the classification operation may also be performed after the toner particles have been dried and obtained as a powder, but it is preferable to perform classification in a liquid because this is more efficient. The unwanted fine particles or coarse particles that are obtained can be sent back to the kneading step and use to form particles of the desired size. Preferably, as many of these fine particles and coarse particles as possible are removed from the dispersion, and this is preferably carried out simultaneously with the classification operation discussed above.

(VII External Addition)

The dried toner powder thus obtained is mixed with other particles, such as releasing agent fine particles, charge control fine particles, fluidizer fine particles, or colorant fine particles, and the mixed powder may be subjected to mechanical impact to fix and fuse the particles at the surface, and prevent the other particles from falling off the surface of the composite particles thus obtained. Specific ways to accomplish this include a method in which a mixture is subjected to an impact force by blades rotating at high speed, and a method in which a mixture is put into a high-speed gas flow and accelerated, so that the particles collide with each other, or composite particles collide with a collision plate. Examples of the apparatus used for this include an Ong Mill (manufactured by Hosokawa Micron), a modified I mill (manufactured by Nippon Pneumatic) in which the pressure of pulverization air is reduced, a Hybridization System (manufactured by Nara Machine), a Kryptron System (manufactured by Kawasaki Heavy Industries), and an automatic mortars.

VIII External Additive (VIII-1 Inorganic Fine Particles)

Inorganic fine particles can be used favorably as an external additive for augmenting the fluidity, developing property, and chargeability of the colorant particles that are obtained. The primary particle size of these inorganic fine particles is preferably from 5 nm to 2 μm, and more preferably from 5 nm to 500 nm. The specific surface area as measured by BET method is preferably from 20 $m^2/g$ to 500 $m^2/g$. The proportion in which these inorganic fine particles are used is preferably from 0.01 wt % to 5 wt %, and more preferably from 0.01 wt % to 3.0 wt %, with respect to the toner. Specific examples of inorganic fine particles include silica, alumina, titanium oxide, barium titanate, magnesium titanate, calcium titanate, strontium titanate, zinc oxide, tin oxide, quartz sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride.

(VIII-2 Polymeric Fine Particles)

In addition, polymeric particles may be used, such as methacrylic ester or acrylic ester copolymers or polystyrene obtained by soap-free emulsion polymerization or dispersion polymerization; polycondensates of silicone, benzoguanamine, nylon, and the like; and polymer particles produced from thermosetting resins.

(VIII-3 External Additive Surface Treatment)

Such fluidizers can be surface treated to make them hydrophobic, which prevents the fluidity and charge properties from being adversely affected even under high humidity. Examples include silane coupling agents, silylation agents, silane coupling agents including a fluoroalkyl group, organic titanate-based coupling agents, aluminum-based coupling agents, silicone oils, and modified silicone oils.

IX Cleaning Auxiliary)

A cleaning improver may be used to remove any developer remaining after transfer on a photosensitive member or a primary transfer medium, examples of which include zinc stearate, calcium stearate, stearic acid, and other such fatty acids and metal salts thereof; and polymer fine particles manufactured by a soap-free emulsion polymerization method or the like, such as polymethyl methacrylate fine particles and polystyrene fine particles. The polymer fine particles preferably have a relatively narrow particle size distribution and a volume average particle size of from 0.01 μm to 1 μm.

X Charge Control Agent

A charge controlling agent may be contained as needed in the toner of the present invention. Any compound known as a charge controlling agent can be used, example of which include nigrosine dyes, triphenylmethane dyes, metal chromium-containing complex dyes, molybdic acid chelate pigments, rhodamine dyes, alkoxyamines, quaternary ammonium salts (including fluorine-modified quaternary ammonium salts), alkylamides, phosphorus and compounds thereof, tungsten and compounds thereof, fluorine-containing activators, metal salts of salicylic acid, and metal salts of salicylic acid derivatives. Specific examples include Bontron 03 (a nigrosine dye), Bontron P-51 (a quaternary ammonium salt), Bontron S-34 (a metal-containing azo dye), E-82 (a metal complex of oxynaphthoic acid) E-84 (a metal complex of salicylic acid), and E-89 (a phenolic condensate), all of which are manufactured by Orient Chemical Industries; TP-302 and TP-415 (molybdenum complexes of a quaternary ammonium salt), which are manufactured by Hodogaya Chemical; Copy Charge PSY VP2038 (a quaternary ammonium salt), Copy Blue PR (a triphenylmethane derivative), Copy Charge NEG VP2036 and NX VP434 (quaternary ammonium salts), all of which are manufactured by Hoechst; LRA-901 and LR-147 (the latter a boron complex), which are manufactured by Japan Carlit; copper phthalocyanine, perylene, quinacridone, azo pigments, and macromolecular compounds having a functional group such as a sulfonate group, a carboxyl group, or a quaternary ammonium group.

(X-1 Amount of Charge Control Agent)

The amount in which the charge controlling agent is used is determined by the type of binder resin being used, whether or not an additive is used, and the toner manufacturing method (including the dispersion method), and cannot be unconditionally specified, but preferably the amount is from 0.1 parts by weight to 10 parts by weight, and more preferably from 0.2 parts by weight to 5 parts by weight, per 100 parts by weight binder resin. If the amount is more than 10 parts by weight, the toner will be too prone to charging, the effect of the main charge controlling agent will be diminished, the electrostatic attraction to the developing roller will increase, and this leads to decreased fluidity of the developer and to lower image density. The charge controlling agent can be dissolved and kneaded together with a master batch and a resin, or it can of course be added during dissolution or dispersal in an organic solvent. Furthermore, it may be externally admixed with a HENSCHEL mixer or the like.

(Process Cartridge)

Figure 2:
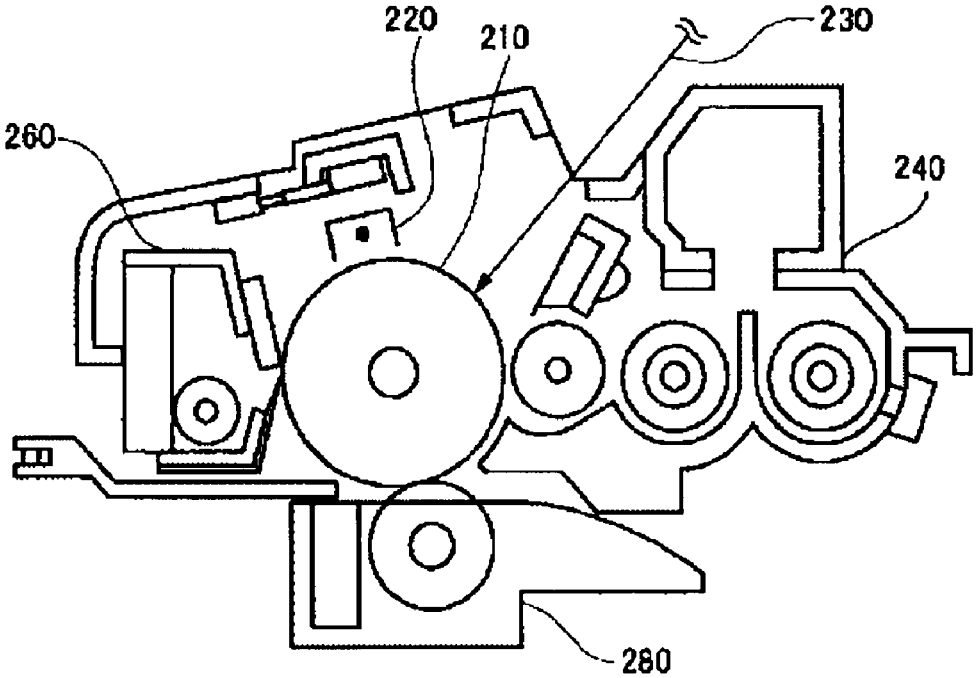
FIG. 2 is a diagram illustrating an example of the process cartridge of the present invention.

The developer of the present invention can be used in image forming apparatus equipped with the process cartridge shown in FIG. 2, for example.

With the present invention, a plurality of constituent elements, such as a latent electrostatic image bearing member, an electrostatic latent image charging unit, a developing unit, and a charging member for recharging toner that remains on the surface of the latent electrostatic image bearing member after transfer from the latent electrostatic image bearing member to the next step, are integrally joined together as a process cartridge, and this process cartridge can be removably installed in the main body of a copier, printer, or other such image forming apparatus.

The process cartridge shown in FIG. 2 has a latent electrostatic image bearing member, an electrostatic latent image charging unit, a charging member for recharging toner that remains on the surface of the latent electrostatic image bearing member after transfer from the latent electrostatic image bearing member to the next step, and a developing unit. In the operation of this process cartridge, the latent electrostatic image bearing member is rotationally driven at a specific peripheral speed. In the course of rotating, the latent electrostatic image bearing member receives from the charging unit a uniform, positive or negative electrical charge of a specific potential around its periphery, and then receives image exposure light from an image exposing unit, such as slit exposure or laser beam scanning exposure, and in this way an electrostatic latent image is steadily formed on the periphery of the latent electrostatic image bearing member. The electrostatic latent image thus formed is then developed with toner from the developing unit, and the developed toner image is steadily transferred by a transfer unit onto a transfer material that is fed from a paper supplier to in between the latent electrostatic image bearing member and the transfer unit, in synchronization with the rotation of the latent electrostatic image bearing member.

The transfer material that has received the transferred image is separated from the surface of the latent electrostatic image bearing member, introduced into an image fixing unit, where the image is fixed, and this product is printed out from the device as a copy or a print. Any toner remaining on the surface of the latent electrostatic image bearing member after image transfer from the latent electrostatic image bearing member to the next step is recharged by the charging member, passes through the latent electrostatic image bearing member charging component, and is recovered in the developing step and repeatedly used for image formation.

(Charging Member)

When toner adhesion is taken into account, the charging member for recharging the toner remaining on the surface of the latent electrostatic image bearing member after transfer from the latent electrostatic image bearing member to the next step is preferably conductive, as charge-up adhesion will occur if it is insulating.

The surface resistance is preferably from $10^2$ Ω/sq to $10^8$ Ω/sq, and the volumetric resistance from $10^1$ Ω·cm to $10^6$ Ω·cm.

Examples of the form of this charging member include that of a roller, a brush, and a sheet, but a sheet configuration is preferable in terms of the resetting of the adhered toner.

The charging member is preferably a sheet made of a material selected from nylon, PTFE, PVDF, and urethane, and from the standpoint of toner chargeability, PTFE or PVDF is better yet.

The surface roughness (Ra) in the present invention expresses the arithmetic mean roughness (μm) in the lengthwise direction. The surface roughness (Ra) here can be measured using a contact surface roughness meter manufactured by Surfcom, as set forth in JIS B 0601-1994, for example.

If the charging member is a conductive sheet, a thickness of from 0.05 mm to 0.5 mm is preferable from the standpoint of the contact pressure against the latent electrostatic image bearing member.

If the charging member is a conductive sheet, a nip width at contact with the latent electrostatic image bearing member of from 1 mm to 10 mm is preferable from the standpoint of contact time while the toner is being charged.

From the standpoint of charging the toner, the voltage applied to the charging member is preferably from −1.4 kV to 0 kV.

The toner was analyzed and evaluated as follows. Furthermore, the toner was evaluated as a single-component developer, but the toner of the present invention can also be used as a two-component developer by using suitable external additives and a suitable carrier.

(Measurement Method)

(Particle Size and Micropowder Amount)

The method for measuring the particle size distribution of the toner will now be described.

The particle size distribution of a toner can be measured using a Coulter Counter TA-II or Coulter Multisizer II (both manufactured by Coulter). The measurement method will now be described.

First, 0.1 mL to 5 mL of a surfactant (preferably an alkylbenzene sulfonate) is added as a dispersing agent to 100 mL to 150 mL of an electrolyte aqueous solution. Here, the electrolyte was an approximately 1% NaCl aqueous solution prepared using extra-pure sodium chloride, such as Isoton-II (manufactured by Coulter). 2 mg to 20 mg (as solids) of measurement sample is then added. The same is suspended in the electrolyte and dispersed with an ultrasonic disperser for about 1 minute to 3 minutes, the volume of toner and the number of toner particles are measured with the above measurement device at an aperture of 100 μm, and the volume and number distributions are calculated. The volume average particle size (Dv) and the number average particle size (Dp) can be determined from the resulting distributions.

Thirteen channels are used, as follows: from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, and from 32.00 μm to less than 40.30 μm. Therefore, particles having a size of from 2.00 μm to less than 40.30 μm can be measured. When the channel straddles 3 μm, the calculation assumes that the particles are included uniformly in the channel.

(Average Circularity)

A good way to measure the shape of a particle is by an optical detection band method in which a particle suspension is allowed to pass through a photographic detection band located on a plate, and the particle images are optically detected and analyzed with a CCD camera. The average circularity is determined by dividing the boundary length of an equivalent circle having an equal projected area as obtained by this method by the boundary length of the measured particle.

This value is the value measured as the average circularity with an FPIA-2000 flow-type particle image analyzer. Specifically, the measurement is performed by adding from 0.1 mL to 0.5 mL of a surfactant (preferably an alkylbenzene sulfonate) as a dispersing agent to from 100 mL to 150 mL of water in a vessel from which solid impurities have been removed, and then adding about 0.1 g to 0.5 g of the measurement sample. The suspension in which the sample has been dispersed is subjected to a dispersion treatment for approximately 1 to 3 minutes by an ultrasonic disperser, and the shape and distribution of the toner particles are measured by the above device at a dispersion concentration of 3,000 to 10,000 particles per microliter.

(Adhesive Strength of Inorganic Fine Particles)

In a vessel, 2 g of toner was put in 30 mL of a surfactant solution diluted 10 times, and was worked thoroughly into the solution, after which an ultrasonic homogenizer was used to impart energy at 40 W for 1 minute to separate the toner. The toner then was washed and dried, and the ratio of the adhering amounts of silica before and after the treatment was calculated with a fluorescence X-ray spectrometer. In this fluorescence X-ray analysis, a wavelength-dispersive fluorescence X-ray spectrometer XRF1700 manufactured by Shimadzu was used to quantify silicon of silica by a calibration method from toner pellets prepared by applying a force of 1N/cm$^2$ to 2 g of the dry toner obtained by the above treatment and to 2 g of pre-treatment toner, for 60 seconds.

(Adhesive Force Among Toner Particles)

A vertically-dividable cylindrical cell was filled with a specific amount of toner in the approximate center of the cylinder, and the toner was compressed at a pressure of 1.1 kgf/cm$^2$ to produce a toner aggregate, after which the two ends of the cell holding this toner aggregate were pulled, and the tensile strength (gf/cm$^2$) at break of the toner aggregate was measured. Because the cell could be separated into an upper cell and a lower cell, just the stress of the toner aggregate could be measured.

[Measurement Conditions]

Compression Conditions:

toner filling amount: 5 g compression rate: 0.02 mm/second holding time: 300 seconds Tensile Test Conditions:

pulling rate: 0.6 mm/second cell temperature: 45.0° C.

humidity: 50%

Characteristics Measurement Apparatus:

AGROBOT (manufactured by Hosokawa Micron)

Evaluation Method (Cleaner-Less Suitability Evaluation: Developing Recovery)

The charging roller of an IPSIO CX3000 (manufactured by Ricoh) was replaced with a brush roller, the cleaning blade of the latent electrostatic image bearing member was removed, and a conductive sheet was installed therein so as to be in contact with the latent electrostatic image bearing member surface. This produced a latent electrostatic image bearing member cleaner-less system as in the following schematic. In monochrome mode, a specific print pattern with a B/W ratio of 6% was printed continuously for 1,000 sheets under an N/N environment (23° C., 45%). The developing recovery here was ranked as a cleaner-less suitability evaluation.

(1) The developing recovery was evaluated by using tape to peel off toner remaining on the photosensitive body at the point when 1,000 sheets of printing was concluded, and measuring L* with an Xrite 939 spectrodensitometer.

excellent: 90 or more good: 85 or more and less than 90 fair: 80 or more and less than 85 poor: less than 80

(2) Conductive sheet (charging member) adhesion was evaluated by evaluating the vertical black streaks and bands in an image outputted at an unsatisfactory charge, by organoleptic visual test, based on the following criteria.

excellent: no streak band in a halftone image (2×2) of 600 dpi good: a few (10 or less) small streaks and thin bands seen poor: many large streaks and bands seen (Fixing/Separation Evaluation)

A toner (developer) that had undergone external additive treatment was used in an IPSIO CX2500 (manufactured by Ricoh) to produce an unfixed image by printing a solid image (adhesion amount: 9 g/m$^2$) with a width of 36 mm on A4 vertical-feed paper 3 mm from the front edge thereof. The following fixing apparatus was used to fix the unfixed image at a fixing temperature of from 130° C. to 190° C. in 10° C. steps so that a separable/no offset temperature range could be determined. In this temperature range, the paper separated well from the heating roller, no offset occurred, and the image did not readily peel off. This is termed the fixing temperature range. The paper used had a basis weight of 45 g/m$^2$, which is favorable for separation, and the feed direction was vertical. The peripheral speed of the fixing apparatus was 120 mm/sec.

Figure 3:
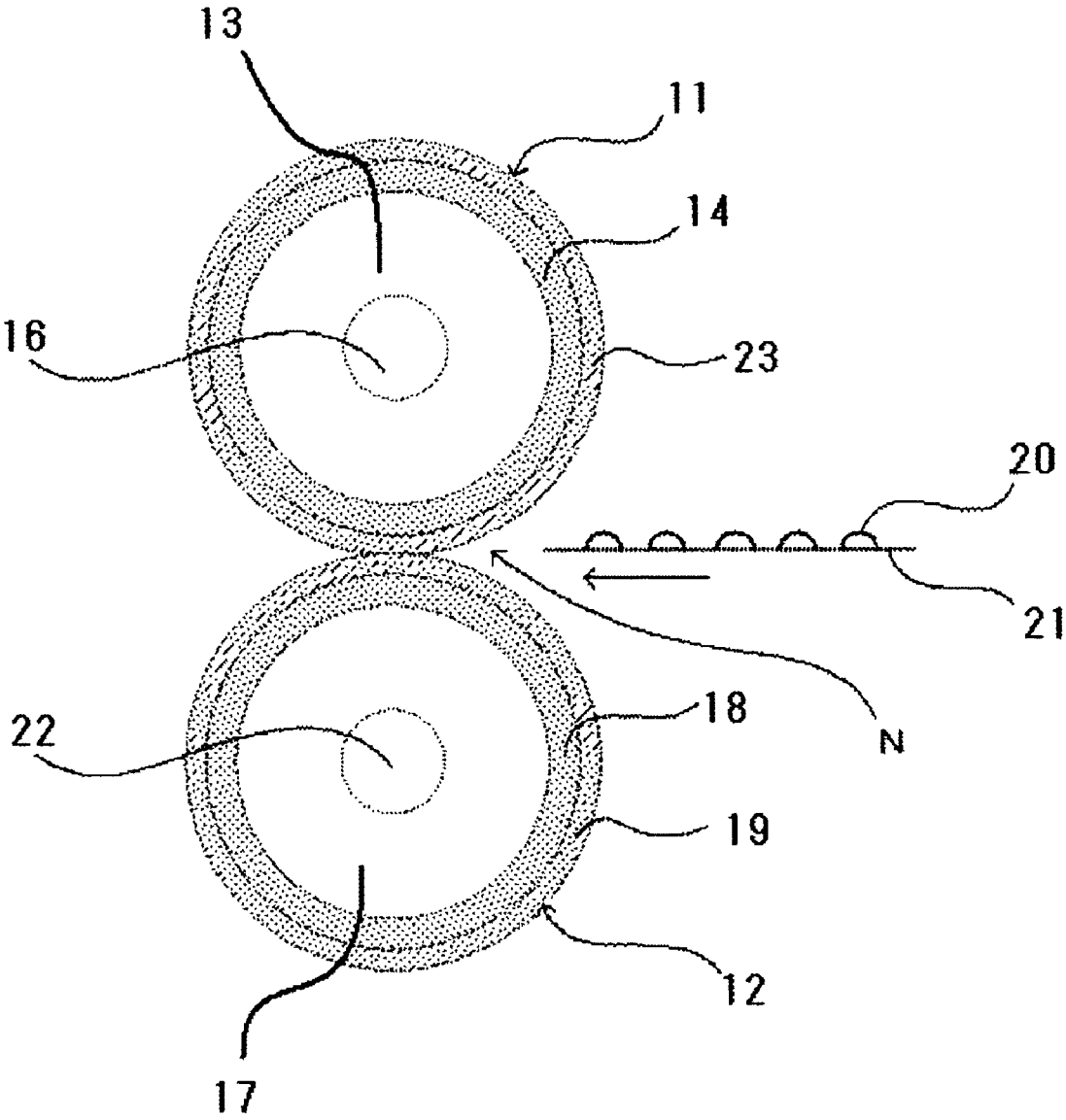
FIG. 3 is a diagram illustrating an example of a fixing device.

The fixing apparatus was a soft roller type with the fluorine surface layer agent configuration shown in FIG. 3. Specifically, a heating roller 11 had an outside diameter of 40 mm, and had an aluminum core 13 over which were provided an elastomer layer 14 composed of silicone rubber and having a thickness of 1.5 mm, and a PFA (tetrafluoroethylene-perfluoroalkyl vinyl ether copolymer) surface layer 15. A heater 16 was provided on the inside of the aluminum core. A heating roller 12 had an outside diameter of 40 mm, and had an aluminum core 17 over which were provided an elastomer layer 18 composed of silicone rubber and having a thickness of 1.5 mm, and a PFA surface layer 19. The paper 21 on which an unfixed image 20 was printed was fed as shown in the drawing.

good: the separable/no offset temperature range was 50° C. or more fair: the separable/no offset temperature range was 30° C. or more and less than 50° C.

poor: the separable/no offset temperature range was less than 30° C.

The process cartridge of the present invention can be detachably mounted to various types of electrophotographic device, and is preferably detachably mounted to the image forming apparatus of the present invention discussed below.

As shown in FIG. 2, for example, the above-mentioned process cartridge includes a photosensitive drum 210, a charging unit 220, a developing unit 240, a transfer unit 280, and a cleaning unit 260, and may have other members as needed. What is numbered 230 in FIG. 2 is exposure by an exposure unit, for which a light source is used that allows writing to be performed at high resolution. The photosensitive drum 210 can be the same as the image forming apparatus discussed below. Any charging member can be used for the charging unit 220.

Next, in an image forming process using the process cartridge shown in FIG. 2, the photosensitive drum 210 rotates while it is charged by the charging unit 220 and exposed to light 230 by the exposure unit (not shown), which forms an electrostatic latent image corresponding to the exposure image on the surface of the drum. This electrostatic latent image is toner developed with the developer of the present invention by the developing unit 240, and this toner image is transferred by the transfer unit 280 to a recording medium and printed out. Then, the surface of the photosensitive drum after image transfer is cleaned by the cleaning unit 260, and is electrically neutralized by a neutralizing unit (not shown), and the above operation is then repeated.

EXAMPLES

The present invention will now be described in further detail by giving Examples and Comparative Examples, but the present invention is not limited to the disclosed Examples. All references to "parts" mean parts by weight.

Example 1

Synthesis of Low-Molecular Weight Polyester

In a reaction vessel equipped with a condenser tube, a stirrer, and a nitrogen inlet tube, 220 parts of a 2 mol ethylene oxide adduct of bisphenol A, 561 parts of a 3 mol propylene oxide adduct of bisphenol A, 218 parts of terephthalic acid, 48 parts of adipic acid, and 2 parts of dibutyltin oxide were put and reacted for 8 hours at 230° C. under normal pressure, and then further reacted for 5 hours under a reduced pressure of 10 mmHg to 15 mmHg, after which 45 parts of trimellitic anhydride was put into the reaction vessel. The mixture was reacted for 2 hours at 180° C. under normal pressure to obtain "low-molecular weight polyester 1." Low-molecular weight polyester 1 had a number average molecular weight of 2,500, a weight average molecular weight of 6,700, a Tg of 43° C. and an acid value of 25.

(Synthesis of Prepolymer)

In a reaction vessel equipped with a condenser tube, a stirrer and a nitrogen inlet tube, 682 parts of a 2 mol ethylene oxide adduct of bisphenol A, 81 parts of a 2 mol propylene oxide adduct of bisphenol A, 283 parts of terephthalic acid, 22 parts of trimellitic anhydride, and 2 parts of dibutyltin oxide were put and reacted for 8 hours at 230° C. under normal pressure, and then further reacted for 5 hours under a reduced pressure of 10 mmHg to 15 mmHg to obtain "intermediate polyester 1." Intermediate polyester 1 had a number average molecular weight of 2,100, a weight average molecular weight of 9,500, a Tg of 55° C., an acid value of 0.5, and a hydroxyl value of 49.

Next, in a reaction vessel equipped with a condenser tube, a stirrer and a nitrogen inlet tube, 411 parts of intermediate polyester 1, 89 parts of isophorone diisocyanate, and 500 parts of ethyl acetate were put and reacted for 5 hours at 100° C. to obtain "prepolymer 1." Prepolymer 1 had a free isocyanate content of 1.53 wt %.

(Synthesis of Master Batch)

In a HENSCHEL mixer, 40 parts of carbon black (Regal 400R, manufactured by Cabot), 60 parts of a binder resin (RS-801 polyester resin, manufactured by Sanyo Chemical Industries; acid value: 10, Mw: 20,000, Tg: 64° C.), and 30 parts of water were mixed to obtain a mixture in which a pigment aggregate was impregnated with water. This mixture was kneaded for 45 minutes at 130° C. in a two-roll kneader with the roll surface temperature set at 130° C., and this product was pulverized to a size of 1 mmϕ with a pulverizer, thereby obtaining "master batch 1."

(Production of Pigment/Wax Dispersion (Oil Phase))

In a vessel equipped with a stirrer and a thermometer, 378 parts of low-molecular weight polyester 1, 127 parts of paraffin wax, 127 parts of the wax dispersing agent described in Japanese Patent Laid-Open (JP-A) No. 2004-246305, and 947 parts of ethyl acetate were put. The contents were heated to 80° C. under stirring, the temperature was held at 80° C. for 5 hours, and then the system was cooled to 30° C. in 1 hour. Then, 500 parts of master batch 1 and 500 parts of ethyl acetate were put in the vessel and mixed for 1 hour to obtain "raw material solution 1."

To the vessel, 1,324 parts of raw material solution 1 was transferred, and the carbon black and the wax were dispersed by passing the system through a bead mill (Ultraviscomill, manufactured by Aimex) filled to 80 vol % with zirconia beads having a diameter of 0.5 mm, for three passes, at a liquid feed rate of 1 kg/hr and a disk peripheral speed of 6 m/sec. Then, 1,324 parts of a 65% ethyl acetate solution of low molecular weight polyester 1 was added, and the system was passed one time through the bead mill under the above conditions to obtain "pigment-wax dispersion 1." Ethyl acetate was added to adjust the pigment-wax dispersion 1 so as to have a solid concentration of 50% (130° C., 30 minutes).

(Preparation of Aqueous Medium)

In 953 parts of water, 88 parts of a 25 wt % aqueous dispersion of a vinyl resin (a copolymer of styrene-methacrylic acid-butyl acrylate-sodium salt of sulfuric acid ester of ethylene oxide adduct of methacrylic acid), 90 parts of a 48.5% aqueous solution of sodium dodecyldiphenyl ether disulfonate (ELEMINOL MON-7, manufactured by Sanyo Chemical Industries), 113 parts of ethyl acetate, and 11.2 parts of potassium persulfate (as a radical generator) were mixed under stirring to obtain a milky white liquid. This was termed "aqueous phase 1."

(Emulsifying Step)

In a vessel, 976 parts of pigment/wax dispersion 1 and 6.0 parts of isophorone diamine (as an amine) were put and mixed for 1 minute at 5,000 rpm with a TK HOMOMIXER (manufactured by Tokushu Kika), after which 137 parts of prepolymer 1 was added and mixed for 1 minute at 5,000 rpm with a TK HOMOMIXER (manufactured by Tokushu Kika), after which 1,200 parts of aqueous phase 1 was added and mixed for 15 minutes at 13,000 rpm with a TK HOMOMIXER to obtain "emulsified slurry 1."

(Solvent Removal)

Emulsified slurry 1 was poured into a vessel equipped with a stirrer and a thermometer, solvent removal was performed for 8 hours at 30° C. and then heat aged for 10 hours at 60° C. to obtain "dispersion slurry 1."

(Washing and Drying)

One-hundred parts of dispersion slurry 1 was filtered under reduced pressure, after which the following steps were carried out.

(1) To the filter cake, 100 parts of ion exchange water were added and mixed with a TK HOMOMIXER (for 10 minutes at 12,000 rpm), and the mixture was then filtered.

(2) 900 parts of deionized water was added to the filter cake obtained in (1), ultrasonic vibration was applied and the components were mixed with a TK HOMOMIXER (for 30 minutes at 12,000 rpm), after which the mixture was filtered under reduced pressure. This operation was repeated so that the electrical conductivity of the reslurry was 10 μC/cm or less.

(3) 10% hydrochloric acid was added to adjust the pH of the reslurry obtained in (2) to 4. This product was then stirred for 30 minutes with a Three-One Motor, and then filtered.

(4) 100 parts of ion exchange water was added to the filter cake obtained in (3), and the components were mixed with a TK HOMOMIXER (for 10 minutes at 12,000 rpm), after which the mixture was filtered. This operation was repeated so that the electrical conductivity of the reslurry was 10 μC/cm or less to thereby obtain "filter cake 1".

Filter cake 1 was dried for 48 hours at 45° C. in a circulating air drier and then sieved through a 75 μm mesh sieve to obtain "toner base particle 1." The weight average particle size (Dv) was 5.6 μm, the number average particle size (Dp) was 5.0 μm, Dv/Dp was 1.12, and the average circularity was 0.97. Next, 1.5 parts of hydrophobic silica H2000/4 (particle size: 12 nm, manufactured by Clariant) and 0.5 part of hydrophobic silica RX50 (particle size: 40 nm, manufactured by Nippon Aerosil) were added to 100 parts of this toner base particle and mixed in a HENSCHEL mixer to obtain "developer 1" of the present invention.

Examples 2 to 6

Developers were produced by the same procedures as in Example 1 above, changing the material composition so that the releasing agent amounts and external additive amounts were as shown in Table 1.

Comparative Examples 1 to 3

Developers of Comparative Examples 1 to 3 were obtained in the same manner as in Example 1, except that the releasing agent-dispersing agent amount and the external additive amounts of Example 1 above were changed as shown in the toner evaluation results in Table 2.

TABLE 1

| | Toner constitution | | | | Toner properties | | | | Recharging sheet | | Evaluation results | |
|---|---|---|---|---|---|---|---|---|---|---|---|---|
| | Particle size (μm) | Micropowder | Circularity | Releasing agent (%) | External additive H2000/4 | External additive RX50 | Adhesive strength | Toner adhesion | Material | Ra | Conductive sheet adhesion | Fixing |
| Ex. 1 | 5.6 | 25 | 0.97 | 4.9 | 1.5 | 0.5 | 48 | 35 | FEP sheet | 0.29 | excellent | excellent |
| Ex. 2 | 5.6 | 25 | 0.96 | 5.3 | 2 | 1 | 79 | 20 | FEP sheet | 0.29 | good | excellent |
| Ex. 3 | 5.6 | 25 | 0.98 | 3.8 | 1.5 | 0.5 | 63 | 28 | FEP sheet | 0.29 | good | excellent |
| Ex. 4 | 5.6 | 25 | 0.95 | 6 | 1.5 | 0.5 | 62 | 25 | PTFE sheet | 0.37 | excellent | excellent |
| Ex. 5 | 5.6 | 25 | 0.98 | 3.5 | 1.5 | 0.5 | 45 | 47 | PFA sheet | 0.25 | good | excellent |
| Ex. 6 | 5.6 | 25 | 0.99 | 2.6 | 1.5 | 0.5 | 50 | 48 | FEP sheet | 0.29 | good | good |
| Comp. Ex. 1 | 5.6 | 25 | 0.95 | 6 | 1.5 | 0.5 | 50 | 48 | FEP sheet | 0.29 | poor | excellent |
| Comp. Ex. 2 | 5.6 | 25 | 0.99 | 2.1 | 1.5 | 0.5 | 80 | 21 | FEP sheet | 0.29 | excellent | poor |
| Comp. Ex. 3 | 5.6 | 25 | 0.97 | 5.3 | 0.5 | 0.5 | 50 | 55 | PVDF sheet | 0.32 | poor | excellent |

Comp. Ex.: Comparative Example
Micropowder: amount, in number %
Toner adhesion: adhesive strength between toner particles

TABLE 2

| | Expression 2 [A × (100 − B)] | Expression 1 [A × (100 − B) × X |
|---|---|---|
| Example 1 | 104 | 509.6 |
| Example 2 | 63 | 333.9 |
| Example 3 | 74 | 281.2 |
| Example 4 | 76 | 456 |
| Example 5 | 110 | 385 |
| Example 6 | 100 | 260 |
| Comparative Example 1 | 100 | 600 |
| Comparative Example 2 | 40 | 84 |
| Comparative Example 3 | 50 | 265 |

What is claimed is:

1. An image forming apparatus comprising:

a latent electrostatic image bearing member, and a recharging unit configured to recharge a residual toner remaining on the latent electrostatic image bearing member, wherein after transfer, the residual toner is passed through the recharging unit and is then recovered in a developing device; a charging component of the recharging unit that comes into contact with the latent electrostatic image bearing member is a polymer sheet having a surface roughness (Ra) of from 0.12 μm to 0.51 μm; the toner comprises at least a pigment, a binder resin, and a releasing agent, and contains inorganic fine particles s as an external additive, and the amount of the inorganic fine particles and the amount of the releasing agent satisfy the following Expressions 1, 2, and 3:

$$[A\times(100-B)]\times X<530 \quad \text{Expression 1}$$

$$[A\times(100-B)]>60 \quad \text{Expression 2}$$

$$X>2.5 \quad \text{Expression 3}$$

where A is the externally added inorganic fine particle content (wt % with respect to toner), B is the adhesive strength of the inorganic fine particles (%), and X is the amount of the releasing agent (wt % with respect to toner).

2. The image forming apparatus according to claim 1, wherein toner particles of the toner have a volume average particle size of 4 microns or more and less than 8 microns, and the content of micropowder toner of 3 μm or smaller is 30 percent by number or less.

3. The image forming apparatus according to claim 1, wherein the adhesive force between toner particles is from 20 g to 50 g.

4. The image forming apparatus according to claim 1, wherein the circularity (S1) of the toner particles (=(the circumferential length of a perfect circle having the same projected area as a particle image)÷(the circumferential length of particle projection)) is 0.95 or more and less than 0.99.

5. The image forming apparatus according to claim 1, wherein the releasing agent contains one or more selected from paraffins, synthetic esters, polyolefins, carnauba waxes, and rice waxes.

6. The image forming apparatus according to claim 1, wherein the toner is a non-magnetic single-component developing toner.

7. The image forming apparatus according to claim 1, wherein the polymer sheet has a conductive sheet portion selected from the group consisting of nylon, PTFE, PVDF, and urethane.

8. The image forming apparatus according to claim 1, being an image forming apparatus used to form a multicolor image.

9. The image forming apparatus according to claim 1, further comprising an endless intermediate transfer unit.

10. The image forming apparatus according to claim 1, further comprising a fixing unit being a roller equipped with a heating device.

* * * * *